US005511289A

United States Patent [19]

Melia

[11] Patent Number: 5,511,289

[45] Date of Patent: Apr. 30, 1996

[54] LOCKING BUCKLE

[76] Inventor: Patricia J. Melia, 11401 S. 257 E. Ave., Coweta, Okla. 74429

[21] Appl. No.: 414,752

[22] Filed: Mar. 31, 1995

[51] Int. Cl.[6] ..... A44B 6/00

[52] U.S. Cl. ..... 24/66.9; 24/459

[58] Field of Search ..... 2/207, 336, 337; 24/113 MP, 136 R, 459, 462, 115 H, 49.1, 66.9

[56] References Cited

U.S. PATENT DOCUMENTS

| | | | |
|---|---|---|---|
| 686,690 | 11/1901 | Fishel | 24/66.9 X |
| 2,087,074 | 7/1937 | Tucker | 24/113 MP |
| 2,128,095 | 8/1938 | Levy | 24/113 MP |
| 3,890,678 | 6/1975 | Leonard, Jr. | 24/66.9 |
| 4,175,305 | 11/1979 | Gillis . | |
| 4,308,647 | 1/1982 | Gillis . | |
| 4,455,717 | 6/1984 | Gray | 24/136 R X |
| 5,005,218 | 4/1991 | Ganz . | |
| 5,156,023 | 10/1992 | Bevolo | 24/113 MP X |
| 5,195,220 | 3/1993 | Herman | 24/113 MP X |

*Primary Examiner*—James R. Brittain
*Attorney, Agent, or Firm*—Molly D. McKay

[57] ABSTRACT

A buckle for use with t-shirts, hair or other similar flexible substrates. The buckle is comprised of a base portion having openings through which the tail of the t-shirt is inserted and a cover which removably locks onto the base, thereby securing the buckle to the t-shirt. The base is provided with two openings separated by a bar and surrounded by an inwardly facing ridge. The ridge is engagable with a series of outwardly facing grooves provided on the cover in order to releasably lock the buckle to t-shirts of various thicknesses.

7 Claims, 2 Drawing Sheets

LOCKING BUCKLE

BACKGROUND OF THE INVENTION

1. Field of the Invention

The present invention relates to a device which locks onto fabrics, hair, draperies or other similar flexible substrates. The device serves a decorative function and serves as a fastener.

2. Description of the Related Art

Over the last decade, t-shirts have become a popular and socially acceptable article of casual clothing. Often t-shirts are highly decorated and quite attractive. One type of ornamentation which has become widely worn in association with t-shirts is the decorative buckle. Decorative buckles come in a wide variety of shapes, sizes and colors to match and coordinate with the wearer's apparel.

These decorative buckles generally have an outside border and a solid bar extending between opposite sides of the border and which separates the external border into two openings. To attach these buckles to a t-shirt, the tail or hem of the t-shirt is inserted first through one of the two openings and then back through the other opening and is held in place simply by friction. These decorative buckles are not limited to use with t-shirts, but can be used for a variety of functions. For example, the uses for decorative buckles include, but are not limited to, use on such flexible substrates as scarves, sashes, hat bands, shirts, tablecloth corners, napkins, towel holders, curtains, food containers, hair, etc.

One of the major problems with the decorative buckles which are currently available is they do not stay fastened where they are put. Because they secure to the flexible substrate by means of friction, the buckles have a tendency to slide downward, under the influence of gravity, causing them to become loosened from the substrate. If the buckle is not readjusted and retightened by tugging on the substrate engaged therein, the buckle will eventually fall off the substrate and may become lost.

The present invention addresses this problem by providing a buckle consisting of two parts, one part for engaging the flexible substrate and a second part for removably locking into the first part in order to hold the buckle securely to the substrate. The second part also can serve a decorative function.

SUMMARY OF THE INVENTION

The present invention is a locking buckle comprised of a base and a cover. The base has an outside border with a bar extending between opposite sides of the border and thereby forming a first and second opening in the base. A ridge is provided facing inwardly on the border such that the ridge, in conjunction with the bar, defines the openings. A substrate is removably insertable in the openings. The cover has a top surface in the same shape and size as the area enclosed by the ridge. A perimeter lip is provided attached to the top surface and extending perpendicularly from a plane in which the top surface lies. A plurality of grooves extend around the perimeter lip so that each groove is parallel to the plane of the top surface and each is of the proper size and shape to receive, in locking fashion, said ridge. Two gaps are provided in the perimeter lip on opposite sides of the cover from each other in order to receive the bar when the cover is attached to the base. The cover removably attaches to the base in order to secure the buckle to the substrate. Decorations or a design may be added to the top surface of the cover for ornamentation.

DETAILED DESCRIPTION OF THE PREFERRED EMBODIMENT

Figure 2:
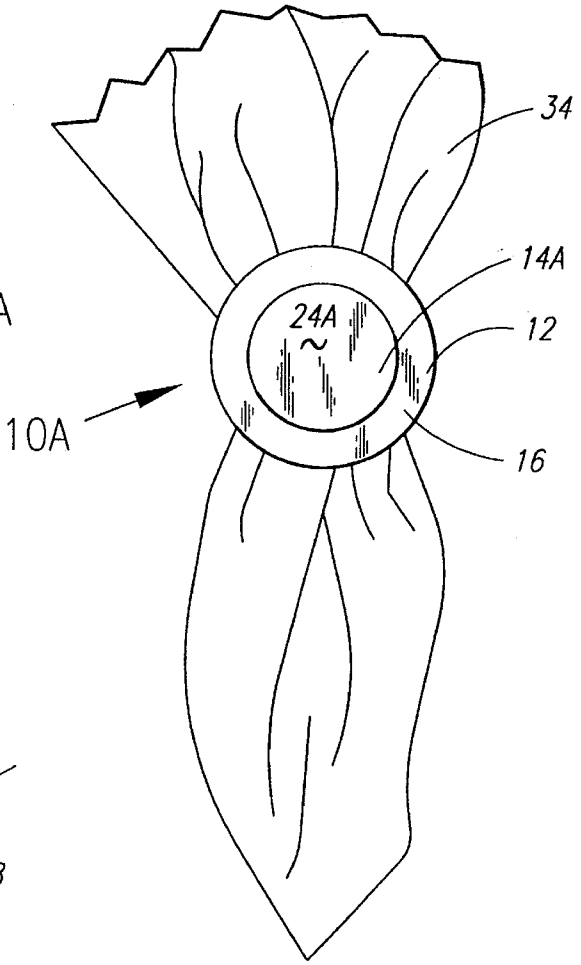
FIG. 2 is a front elevation showing the locking buckle attached to a t-shirt.
Figure 1:
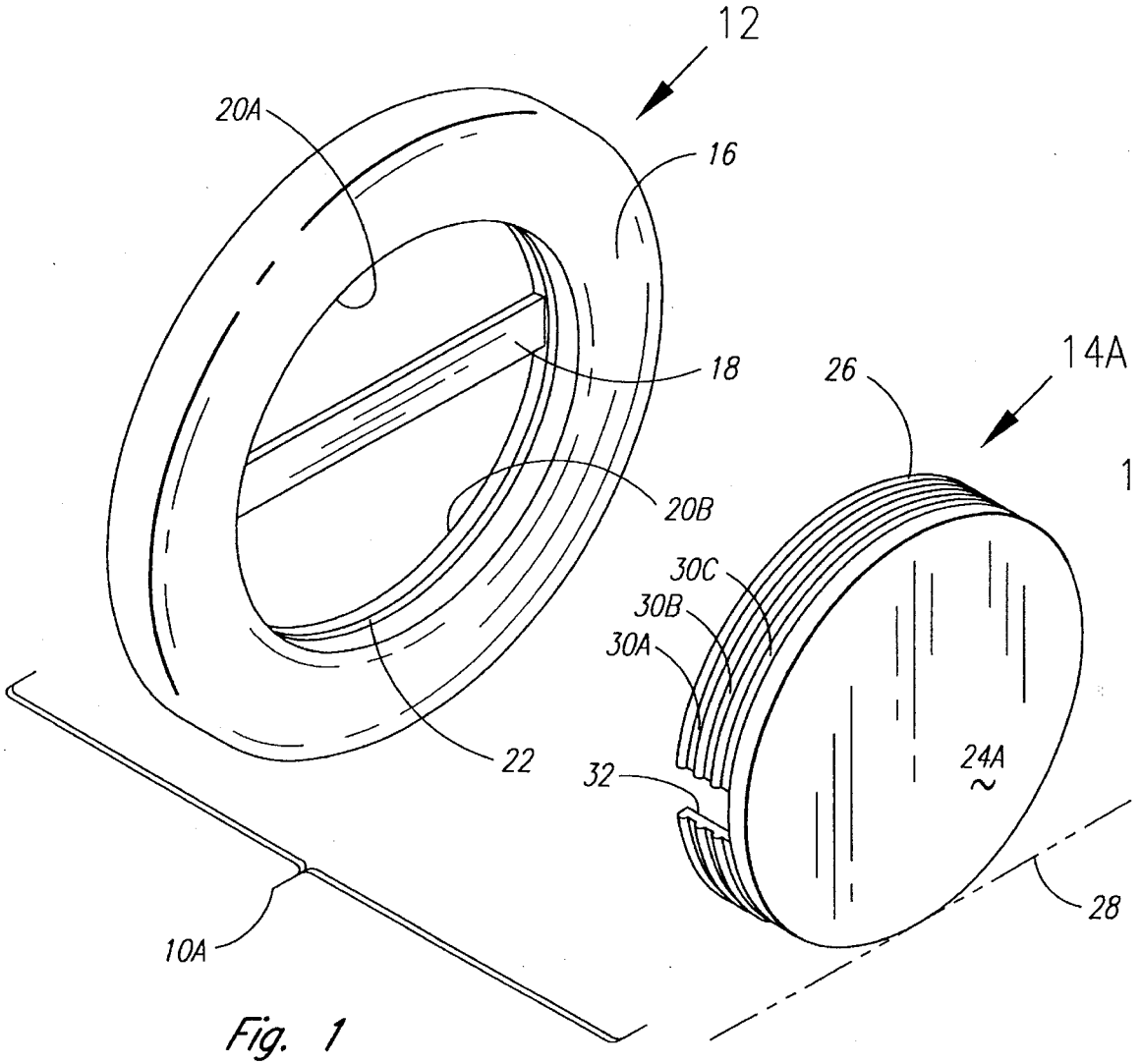
FIG. 1 is an exploded view of a locking buckle constructed according to a first preferred embodiment of the present invention.

Referring now to the drawings and initially to FIGS. 1 and 2, there is illustrated a locking buckle 10A constructed according to a preferred embodiment of the present invention. The buckle 10A is comprised of two separate pieces: a base 12 and a cover 14A.

The base 12 is provided with a continuous outside border 16. A bar 18 extends between opposite sides of the border 16, thereby forming first and second openings 20A and 20B in the base 12. The openings 20A and 20B are enclosed within the border 16 and are separated from each other by the bar 18. The border 16 is provided with an inwardly facing ridge 22 which, in conjunction with the bar 18, defines the openings 20A and 20B.

The cover 14A has a continuous top surface 24A which is the same shape as an area lying within the ridge 22 of the base 12. The top surface 24A has a perimeter lip 26 extending downward and away from the top surface 24A and perpendicular to a plane 28 in which the top surface 24A lies. The perimeter lip 26 is provided with one or more grooves 30 which extend around the perimeter lip 26 so that each groove 30 is parallel to plane 28. Each groove 30 is of the proper dimension and shape to releasably engage the ridge 22 when the cover 14A is attached to the base 12, as will be more fully described hereafter.

The perimeter lip 26 has a pair of gaps 32 provided therein on opposite sides of the perimeter lip 26 in order that the bar 18 enters the gaps 32 as the cover 14A is attached to the base 12. In order to use the locking buckle 10A, the base 12 is first detached from the cover 14A. This is done by pushing on an underneath side of the cover 14A while simultaneously pushing in an opposite direction on the border 16 of base 12, causing them to disengage one another. Then a flexible substrate 34, such as hair or cloth, is first inserted in one direction through one of the openings either 20A or 20B in the base 12, then inserted back in an opposite direction through the other opening, either 20B or 20A, in the base 12. The base 12 is then adjusted to the desired location on the substrate 34. Once in the desired position, the base 12 is locked onto the substrate 34 by attaching the cover 14A to the base 12. This is done by first aligning the gaps 32 with the bar 18, then pushing the cover 14A into the openings 20A and 20 B until the ridge 22 engages the first groove 30A. Depending on the thickness of the substrate 32, it may be desirable to continue to push the cover 14A into the openings 20A and 20B until the ridge 22 engages the second groove 30B. For extremely thin or fine substrates 34, it may be necessary to continue pushing the cover 14A into openings 20A and 20B until the ridge 22 engages the third groove 30C. As the ridge consecutively engages the first groove 30A, then the second groove 30B and finally the last groove 30(3, the cover 14A incrementally increases its grip on the base 12, allowing the buckle 10A to be used on substrates 34 having densities ranging from very bulky to very thin.

Figure 4:
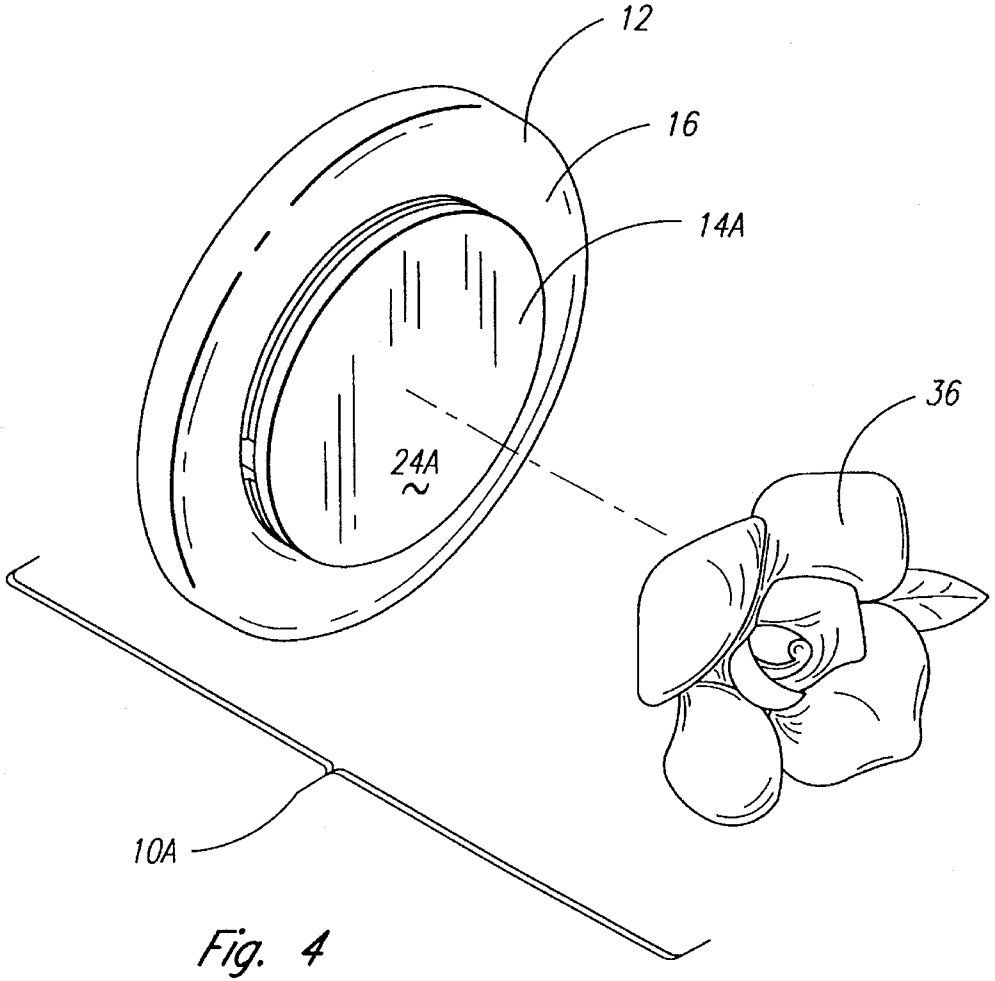
FIG. 4 is a partially exploded view of the buckle of FIG. 1 shown provided with a decoration.

The buckle 10A can be removed from the substrate 34 by pushing the cover 14A and the base 12 in opposite directions to each other, as previously described. If desired and as illustrated in FIG. 4, the top surface 24A of the cover 14A can be provided with a decoration 36, such as a bow, flower, etc. which coordinates with or accents the substrate 34.

Figure 3:
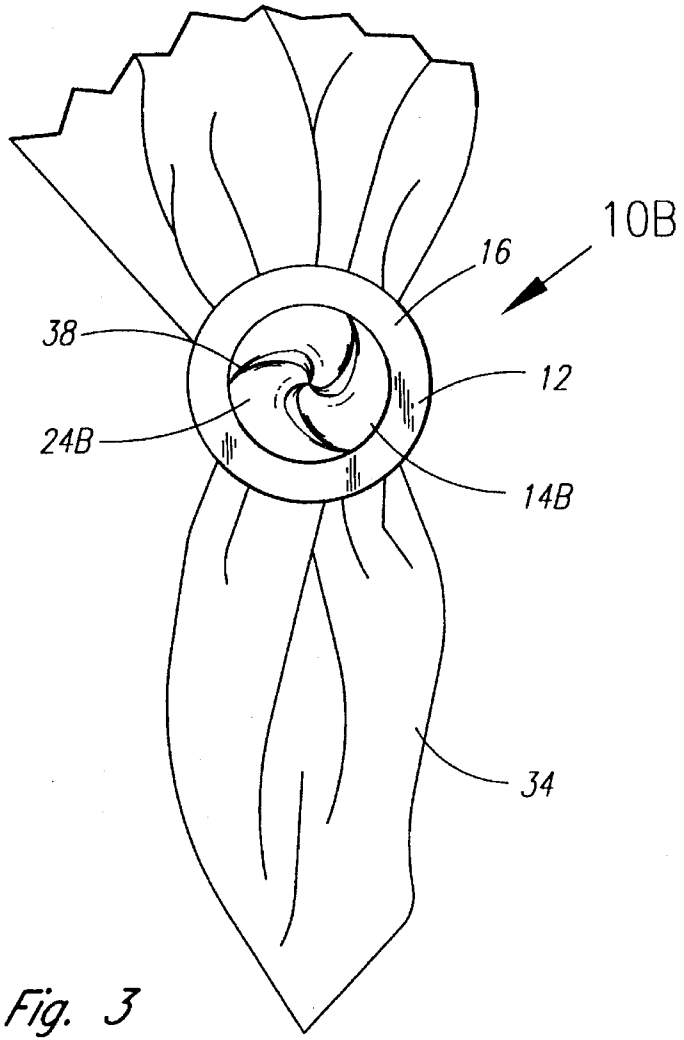
FIG. 3 is a front elevation of a second locking buckle constructed according to a second preferred embodiment of the present invention, showing the second locking buckle attached to a t-shirt.

Referring now to FIG. 3, there is illustrated a second locking buckle 105 constructed in accordance with a second preferred embodiment of the present invention. The second buckle 10B is identical to the first buckle 10A with the exception that a top surface 24B of a second cover 14B of the second buckle 10B is provided with a design 38 instead of the plain flat top surface 24A provided on the first cover 14A of the first buckle 10A. The design 38 may be in the shape of a swirl, star, heart or any other similar design to serve as an ornamentation on the second buckle 10B.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A decorative buckle comprising:

a base removably receiving a substrate, a cover removably attachable to said base so that said substrate is locked between said base and said cover, said base being provided with an outside border, a bar extending between opposite sides of said outside border so that two openings are formed between the bar and the outside border, and said substrate being removably received by said openings in said base, an inwardly facing ridge being provided on said outside border, a perimeter lip being provided on said cover, said perimeter lip being provided with a plurality of outwardly facing grooves for removably receiving said ridge, and said cover being provided with a pair of gaps therein for removably receiving the bar.

2. A decorative buckle according to claim 1 further comprising:

a top surface provided on said cover which lies in a plane perpendicular to said perimeter lip.

3. A decorative buckle according to claim 2 further comprising:

a decoration being provided on said top surface.

4. A decorative buckle according to claim 2 further comprising:

a design being provided on said top surface.

5. A buckle comprising:

a base having a pair of openings into which a substrate may be inserted, a bar being provided between said pair of openings, a cover removably engagable with said base in order to secure said base to said substrate, said base being provided with an inward facing ridge surrounding said openings, said cover being provided with a plurality of outwardly facing grooves for releasably receiving said ridge, and said cover being provided with a pair of gaps for removably receiving said bar when said cover egnages said base.

6. A buckle according to claim 5 further comprising:

a design being provided on said cover.

7. A buckle according to claim 5 further comprising:

a decoration being provided on said cover.

* * * * *